United States Patent [19]

Kotani

[11] Patent Number: 4,668,212

[45] Date of Patent: May 26, 1987

[54] PROCESS FOR MANUFACTURING SEALED POSTAL ENVELOPE ASSEMBLIES

[75] Inventor: Ryuichi Kotani, Kyoto, Japan

[73] Assignee: Iseto Shiko Co. Ltd., Kyoto, Japan

[21] Appl. No.: 682,277

[22] Filed: Dec. 17, 1984

[51] Int. Cl.[4] ..... B31B 21/74; B31F 1/10

[52] U.S. Cl. ..... 493/216; 493/18; 493/210; 493/421; 493/424; 225/100

[58] Field of Search ..... 493/422, 420, 421, 216, 493/210, 224, 249, 442, 424, 454, 8, 17, 18; 225/100, 101, 102

[56] References Cited

U.S. PATENT DOCUMENTS

| | | | |
|---|---|---|---|
| 3,416,785 | 12/1968 | Sherman | 493/420 |
| 4,261,497 | 4/1981 | Roetter et al. | 225/100 |
| 4,312,169 | 1/1982 | Golicz et al. | 493/216 |
| 4,437,852 | 3/1984 | Volk, Jr. et al. | 493/216 |
| 4,455,809 | 6/1984 | Dallaserra | 53/435 |

FOREIGN PATENT DOCUMENTS

| | | | |
|---|---|---|---|
| 64187 | 12/1945 | Denmark | 493/421 |

OTHER PUBLICATIONS

Pitney Bowes, 1981, "Computer Output Mailing System", p. 4.

*Primary Examiner*—Robert L. Spruill

*Assistant Examiner*—David B. Jones

*Attorney, Agent, or Firm*—Morgan & Finnegan

[57] ABSTRACT

Apparatus for forming an assembly of sealed envelopes used as a postal mailer includes a main envelope processing unit for producing envelopes from the envelope-forming continuous sheet, and an intermediate element supply unit exchangably connected with the main envelope processing unit to supply the intermediate element to the main envelope processing unit. The main envelope processing unit including a stock of said envelope-forming continuous sheets; a device for continuously supplying said envelope-forming continuous sheets from said stock; a device for successively separating said envelope-forming continuous sheet supplied along said transverse weakening lines into discrete envelope units; a first feeder for feeding each of said discrete envelope units to an envelope folding and intermediate element inserting station; a folding operation unit in said envelope folding and intermediate element inserting station, said folding operation unit comprising a first folder for folding said discrete envelope unit along said first transverse folding line and a second folder for folding said discrete envelope unit along said second transverse folding line; a second feeder for feeding said intermediate element to said envelope folding and intermediate element inserting station.

5 Claims, 16 Drawing Figures

PROCESS FOR MANUFACTURING SEALED POSTAL ENVELOPE ASSEMBLIES

BACKGROUND OF THE INVENTION

1. Field of the Invention

The present invention relates to the apparatus for manufacturing sealed postal mails or the like sealed envelope assemblies.

More particularly, the present invention relates to such an apparatus for manufacturing continuous sealed mails and envelope assemblies containing intermediate papers that remain free after completing the folding and sealing of envelopes wherein the apparatus processes such envelopes that can be cut off from a continuous sheet along the lateral fold line and folded into three parts at the lateral folding lines and also processes such discrete intermediate elements to be cut off from another continuous sheet or such as the one previously cut off from the continuous sheet or such as the one to be folded at least along a fold line. The apparatus designed for manufacturing either the continuous sealed postal mails or like sealed envelope assemblies selectively combines various intermediate element processors so that any desired type of intermediate elements can be delivered to the main envelope processor.

2. Description of Prior Art

Conventionally available apparatuses of this kind were found suitable for performing such operations, for example, laying up a continuous sheet for the front surface of envelopes, another continuous sheet for the rear surface of envelopes, and at least another continuous sheet for the intemediate elements, followed by sealing these sheets at edges, and finally causing these sheets to be formed into individual envelopes. However, since such conventional apparatuses only deal with a specific form of the intermediate elements despite the growing needs for conveying a variety of information via these intermediate elements, actually, these intermediate element having only a specific form cannot fully suffice the needs for conveying a wide variety of up-to-date information.

SUMMARY OF THE INVENTION

In the light of such disadvantages inherent to conventional apparatuses, the present invention aims at providing such a useful apparatus capable of manufacturing either continuously sealable postal mails or the like envelope assemblies provided with a variety of forms, by allowing the main envelope processor to selectively combine any intermediate element supply unit so that the intermediate elements as the information conveyer can be supplied in a variety of forms.

Another object of the present invention is to provide such a processing unit for the continuous mail sealing, which is suited for the line-printer process using a computer and in addition being particularly effective for the non-impact printing process using heat wherein it comprises such means for concentrically printing information onto a continuous sheet using a computer, while the printable continuous sheet is completely free from the heat-sensitive adhesive layer, and conversely, the heat-sensitive adhesive layer is provided only on the other continuous sheet available for envelopes.

A still further object of the present invention is to provide such a processing unit for the continuous mail sealing wherein it comprises such means for manufacturing sealed envelopes from which the inserted paper can be easily and immediately drawn out by opening at least one side of an envelope, while the sealed envelope contains the insert paper(s) between the front and rear covers, allowing no part of the inserted paper to adhere to the interior of the sealed envelope. The preferred embodiments of the present invention are summarized below.

The present invention relates to such an apparatus that manufactures the sealed postal mails or the like envelope assemblies using a discrete envelope unit split from an envelope-forming continuous sheet and an intermediate element having sizes adapted to be enclosed within the envelope unit.

The apparatus for manufacturing sealed postal mails according to the preferred embodiment of the present invention comprises the main envelope processing unit for producing envelopes from the envelope-forming continuous sheet, and the intermediate elements supply units exchangeably connected with the main envelope processing unit to supply the intermediate element to the main envelope processing unit. Each of the envelopes comprising a front layer and a rear layer. The envelope-forming continuous sheet having transverse weakening lines at regular intervals formed to define envelope unit sections between each adjoining two of the weakening lines, each of the envelope unit sections having first and second transverse folding lines, a front first area for forming said front layer of an envelope defined by first and second transverse folding lines, a second area for forming one portion of the rear layer of the envelope connected to the first area via the first transverse folding line, a third area for forming the other portion of the rear layer of the envelope connected to the first area via the second transverse folding line, and an adhesive layer formed on one surface of said envelope unit section along each of the opposite side edges in direction of the envelope unit section and another adhesive layer formed on the some one surface of the envelope unit section along the outer end transverse edge of the third area.

The main envelope processor is provided with the following:

(I) a stock of said envelope-forming continuous sheet;

(II) means for continuously supplying said envelope-forming continuous sheet from said stock;

(III) means for successively separating said envelope-forming continuous sheet supplied along said transverse weakening lines into discrete envelope units one by one;

(IV) first feeder means for feeding each of said discrete envelope units to an envelope folding and intermediate element inserting station;

(V) a folding operation unit in said envelope folding and intermediate element inserting station, said folding operation unit comprising a first folding means for folding said discrete envelope unit along said first transverse folding line and a second folding means for folding said discrete envelope unit along said second transverse folding line;

(VI) second feeder means for feeding said intermediate element to said envelope folding and intermediate element inserting station;

(VII) sensor means for detecting the delivery timing of said discrete envelope unit delivered by said first feeder means;

(VIII) sensor means for detecting the delivery timing of said intermediate element delivered by said second feeder means;

(IX) means for controlling the delivery amount of relation to the delivery amount of said envelope unit based an output signals from said two sensor means so that said intermediate element can be enclosed within said discrete envelope unit folded; and (X) means for sealing said discrete envelope unit along said adhesive layers of said discrete envelope unit folded to form a completed envelope assembly.

BRIEF DESCRIPTION OF THE DRAWINGS

The invention will be better understood with reference to the description which follows taken in conjunction with the annexed drawings in which.

DESCRIPTION OF PREFERRED EMBODIMENTS

Referring now to the preferred embodiments shown in the attached drawings, details of the apparatus for manufacturing sealed postal mails or the like envelope assemblies reflecting the present invention are described below.

Figure 1:
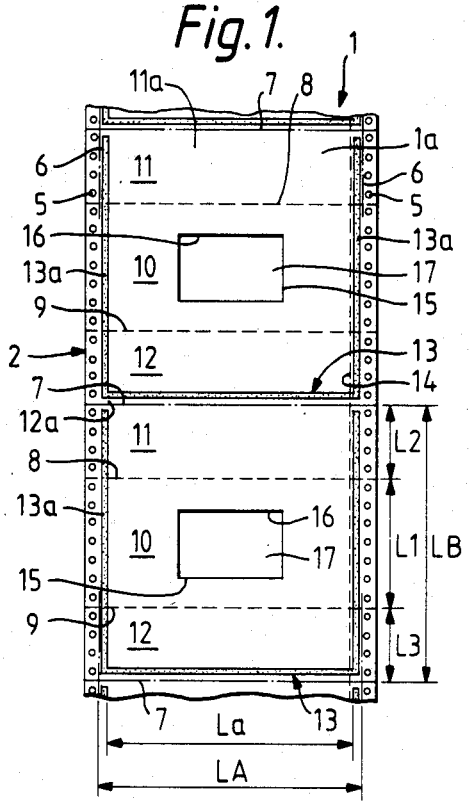
FIG. 1 is a partial plain view of the envelope-forming continuous sheet already processed for application to the apparatus embodied by the invention.
Figure 2:
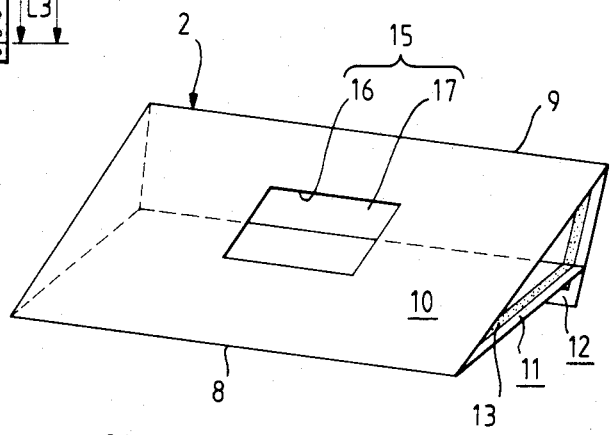
FIG. 2 is a perspective view of a discrete envelope unit made from the envelope-forming continuous sheet.
Figure 3A:
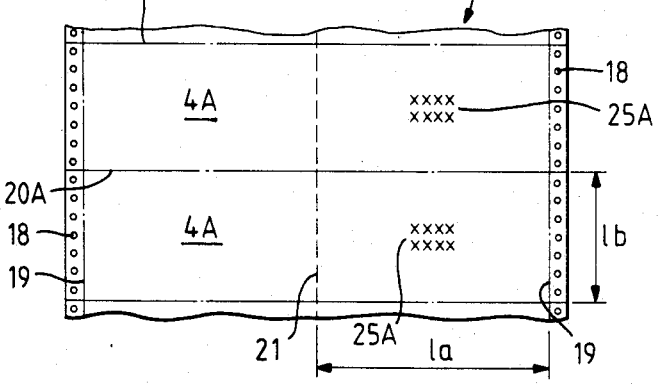
FIGS. 3-A, -B, and -C are respectively the preferred embodiments using the intermediate element forming continuous sheets that are different from each other.
Figure 3B:
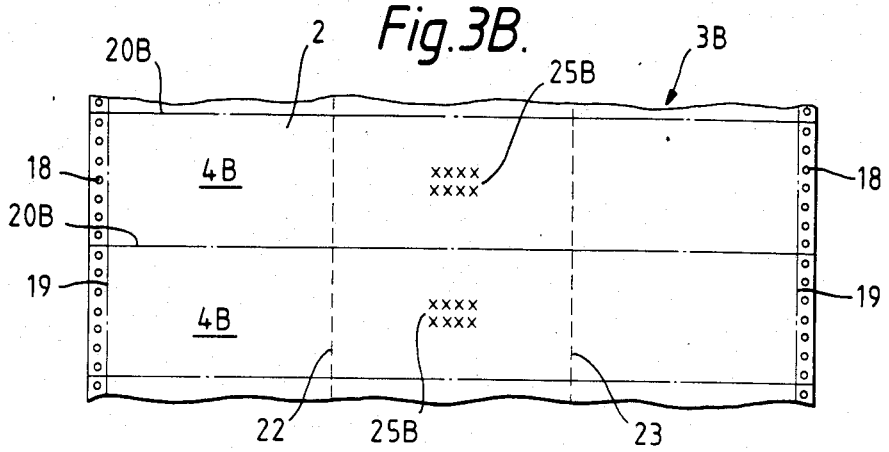
Figure 3C:
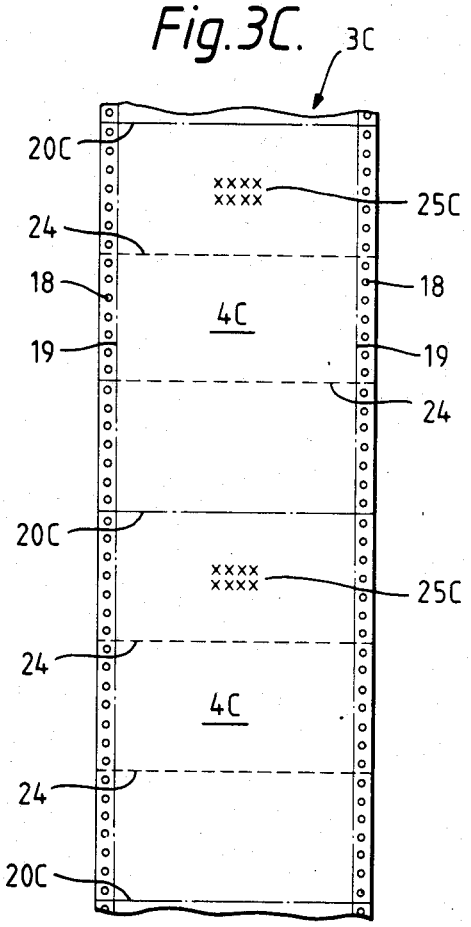
Figure 4A:
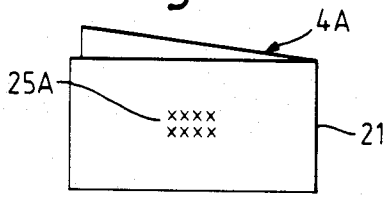
FIGS. 4-A, -B, and -C briefly show perspective views of intermediate elements made from each intermediate element forming continuous sheet shown in FIGS. 3-A and 3-B.
Figure 4B:
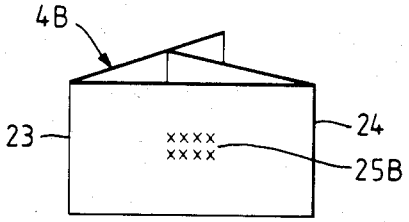
Figure 4C:
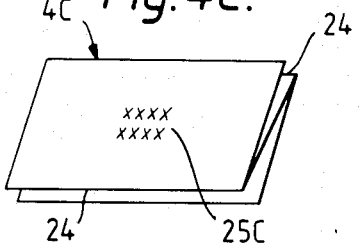
Figure 5:
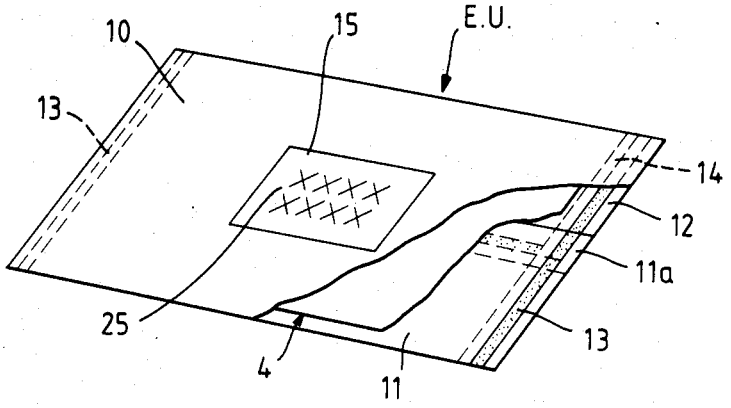
FIG. 5 shows a partially exploded view of a window-provided envelope after completing the sealing process.

Basically, the sealed mail manufacturing apparatus embodied by the present invention is designed to continuously make up envelope units (E.U.) by individually feeding the following into the apparatus; discrete envelopes (2) split from a continuous sheet (1) available for envelopes and discrete intermediate elements (4A, 4B and 4C) made from intermediate-forming continuous sheets (3A, 3B and 3C) available for intermediate elements shown in the preferred embodiment of FIG. 3. An example of the envelope forming continuous sheet (1) is shown in FIG. 1. This sheet (1) is provided with marginal perforation lines (5) and (5) along opposite edes in the direction of its length and also with the marginal perforation split lines (6) and (6) so that the marginal perforation lines (5) and (5) can be cut off along the internal line of these lines (5) and (5). Distance (LA) between the marginal perforation split lines (5) and (5) corresponds to the length of the longitudinal edges of a complete envelope unit (E.U). The continuous sheet (1) is provided with the tearable transverse weakening lines (7) at regular intervals (LB) in the direction of length, thus defining the area available for the discrete envelope and forming a discrete envelope unit (2) by splitting it from the tearable transverse weakening lines (7). The discrete envelope unit (2) defined by the tearable transverse weakening lines (7) is provided with the first and second transverse folding lines (8) and (9) allowing it to be sequentially folded in the identical direction. The discrete envelope unit (2) is sectioned by the first and second transverse folding lines (8) and (9) to form the first area (10) located in the center position and the second and third areas (11) and (12) located on opposite sides. As shown in FIG. 2, the discrete envelope unit (2) is designed so that the inner rear portion (11) is first folded along the first folding line (8) and then the outer rear portion (12) is folded along the second folding line (9). Length (L1) of the front portion of the envelope corresponds to the length of one side of a complete envelope unit (E.U). Dimensions (LA) and (L1) are optionally determined by the pre-designated size of the complete envelope unit (E.U), whereas dimensions (L2) and (L3) of the rear portions (11) and (12) are designed so that the value of the sum of L2 and L3 is greater than the length (L1) of the front portion of the discrete envelope unit (2), i.e., it is designed so that the transverse edges (11*a*) and (12*a*) of the rear portions (11) and (12) are overlapped to produce the sizing area when folding the discrete envelope unit (2) along the folding lines (8) and (9). Length (L2) and (L3) of the rear portions (11) and (12) shall desirably be designed so that $L2=L3=\frac{1}{2}L1+\frac{1}{2}a$ (a indicates the dimensions of the overlapped area) in relation to the length (L1) of the front surface area (10) of the envelope. On the other hand, the envelope sealing adhesive layer (13) is provided on the inner surface of the envelope-forming area of the continuous sheet (1) in the direction of the transverse folding line. The adhesive layer (13) comprises two layers; the one (13*a*) provided along the inner edges of the marginal perforation split lines (6) and (6) and the other layer (13*b*) provided along the inner part of the transverse edges (12*a*) of said third rear area (12) of the envelope unit (2), whereas no adhesive layer is provided along the transverse edge portion (11*a*) of said second rear area (11) of the envelope unit (2). Either thermobonding adhesive agent, pressure-bonding adhesive agent, or water-soluble thickener may be optionally used for the adhesive layer (13). Slits (14) are provided along the inner edge of the adhesive layer (13) in such a position corresponding to one-side of a complete envelope unit (E.P). In addition, a see-through window (15) is provided at an appropriate position of the front area (10) of the envelope unit of the continuous sheet (1). Such a see-through window may be formed by bonding a see-through sheet (17) to the opening (16) on the front area (10) from the inner surface (1*a*) of the continuous sheet (1) using adhesive agent, or it may be of such a makeup allowing external viewing of a specific part of the written information contained in the envelope. Three of the preferred embodiments (3A), (3B) and (3C) in conjnction with the continuous sheets available for the intermediate elements to be inserted into envelopes are shown in FIGS. 3-A, -B, and -C, respectively. Each of these continuous sheets (3A), (3B), and (3C) available for the intermediate sheets is provided with marginal perforation lines (18) and (18) and split lines (19) and (19) for splitting the marginal perforations along the longitudinal edges. The intermediate element forming continuous sheet (3A) shown in FIG. 3-A makes up the intermediate elements that are longitudinally folded into two parts as shown in FIG. 4-A. The continuous paper (3A) sections the longitudinally double-folded intermediate element (4A) along the marginal peforation split line (19) and the tearable weakening lines (20A). When the intermediate element (4A) is longitudinally folded into two parts by the longitudinal folding (21), the intermediate element (4A) fits itself within the length (L1) between the first and second transverse folding lines (8) and (9) of the discrete envelope unit (2), where the intermediate element (4A) has such a size not overlapping the inner length (La) of the adhesive layers (13*a*) and (13*b*) provided along the inner edges of the marginal perforation split line (6) of the discrete envelope unit (2). On the other hand, the intermediate element forming continuous sheet (3B) shown in FIG. 3-B makes up the longitudinally triple-folded intermediate element (4B) shown in FIG. 4-B. The continuous sheet (3B) having transverse weakening lines (20B), (20B) at regular intervals, the longitudinally folding lines (22) and (23) that fold the intermediate element in the same direction are provided between said weakening lines (20B), (20B). On the other hand, the intermediate element forming continuous sheet (3C) shown in FIG. 3-C respectively make up transversely triple-folded intermediate elements (4C). The intermediate paper forming continuous sheet (3C) also sections the transversely triple-foldable intermediate element (4C) along the marginal perforations (18) and split lines (19) as well as along the tearable weakening lines (20C). The transversely triple-foldable intermediate element is provided with transversely folding lines (24) and (25) so that it can be transversely folded into three parts. Note that both the transverse and longitudinal length (la) and (lb) of the intermediate elements (4A) and (4B) as well as (4C) are determined according to specific sizes (La) and (L1) optionally preset for the discrete envelope unit (2), whereas the transverse and longitudinal length (la) and (lb) shall be slightly shorter than the length (La) and (L1), respectively. Address printing areas (25A), (25B) and (25C) that are available, for example, for automatically printing names of addresses and their addresses using a computerized system, are provided in such a portion which is located on the front surfaces (3*a*) of the intermediate element forming continuous sheets (3A), (3B), and (3C) and also matches the location of the see-through window (15) on the front surface area (10) of the envelope forming continuous sheet (1).

The continuous sealed mail manufacturing apparatus (26) embodied by the present invention basically comprises the main envelope processor (27), the intermediate element burst processing unit (28) which can be selectively combined with the main envelope processor (27) for feeding any desired form of the intermediate papers to the main envelope processor (27), the longitudinally triple-folding unit (29), transverse-folding unit (30), and the simple intermediate element inserting unit (31). The preferred embodiment also provides such a system in which the longitudinal folder unit (34) composed of the continuous sheet expander bar (32) and a pair of fold-aligning rollers (33) are connected to the front part of the intermediate element burst processing unit (28). The main envelope processor (27) is provided with the first feeder unit (35) that delivers the discrete envelope unit (2) to the envelope folding and intermediate element inserting station (F.P) and the second feeder unit (36) that delivers the intermediate element (4) to said envelope folding and intermediate element inserting station (F.P). The discrete envelope unit (2) is processed by the burst processor (37) before being delivered to the first feeder unit (35). The envelope-forming continuous sheet (1) is held by the continuous sheet holder (38) and then drawn out by the pin tractor unit (39) via an appropriate guide roller (40). After being drawn out by the pin tractor unit (39), the continuous sheet (1) is then split by the splitter (41) at the marginal perforations (5) and (5), which is then burst-processed while passing through a pair of tearing rollers (42) and (43) and finally delivered to the first delivery unit (35). A pair of tearing rollers (42) and (43) cause the envelope-forming continuous sheet (1) to be cut off along the tearable transverse weakening lines (7) by means of the differential speed of rotation between both rollers.

Figure 12:
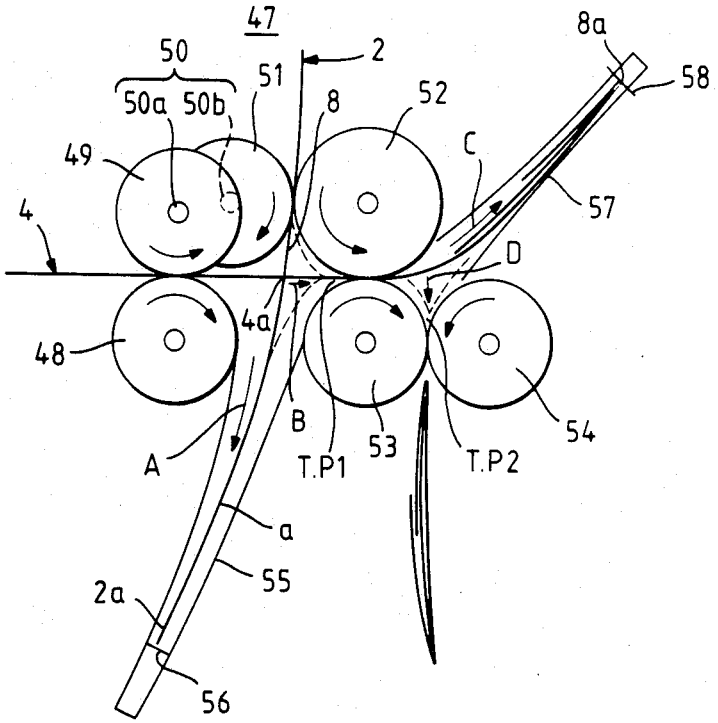
FIG. 12 is an enlarged lateral view showing the detailed configuration of the transversely folded discrete envelope.

Sensor means (44) available for detecting the predetermined delivery timing of the discrete envelope units (2) is provided between the first feeder unit (35) and the folding and inserting station (F.P), which outputs a detect signal (e1) when detecting the delivery timing of the discrete envelope units (2). In conjunction with the second feeder unit (36), another sensor (45) is provided, which outputs a detect signal (e2) when detecting the delivery timing of the intermediate papers (4). The second feeder unit (36) is designed to operate at a constant speed synchronous with other parts driven by the main motor, and if any difference occurs in the calculated values between the timing detect signals (e1) and (e2), the second feeder unit (36) instantly accelerates or decelerates its operation speed using its own pulse motor (not shown). The folder unit provided for the fold-adjustment position (F.P) is described in FIG. 12. The folder unit (47) is provided with a pair of feed-rollers (48) and (49) that deliver the intermediate elements (4) to the folding and inserting station wherein the folder unit comprises the drive roller (48) and the other roller (49) which is secured to the first shaft (50*a*) of the stationary crank shaft (50) through bearings so that it can freely rotate and be pressed against the drive roller (48) along the basic line. A roller (51) is secured to the second shaft (50*b*) of the crank shaft (50) through bearings so that it can rotate freely. This roller (51) makes up a pair with the drive roller (52) so that they are in contact with each other along the basic line. The folder unit (47) comprises the first pair of folding rollers composed of the drive roller (52) and the counterpart roller (53) available for folding the discrete envelope unit (2) along the first transverse-folding line (8) and the second pair of folding rollers composed of rollers (53) and (54) for folding the envelope unit (2) along the second transverse-folding line (9). After being sent out of these rollers (51) and (52), the discrete envelope unit (2) is then delivered in the arrowed direction A along the guide (55), while the discrete envelope unit (2) starts to bend itself in the arrowed direction B when its leading edge comes into contact with the stopper (56) which is adjustable to any desired position. The stopper (56)

presets the position of the discrete envelope unit (2) so that the first traverse-fold line (8) can be positioned at the inlet (T.P1) of the first pair of feeding rollers (52) and (53). Now, the leading edge (4*a*) of the intermediate element (4) which was synchronously sent out of a pair of rollers (48) and (49) remains being inserted between the discrete envelope units in contact with the first transverse-folding line (8) of the discrete envelope unit (2), and then the leading edge (4*a*) is inserted between the first pair of folding rollers (52) and (53). Both the discrete envelope unit (2) and the discrete intermediate element (4) are then delivered by these folding rollers (52) and (53) in the arrowed direction C along the guide (57), and when the first folded end (8*a*) being the edge of the first fold line comes into contact with the position-adjustable stopper (58), the first folded end (8*a*) starts to bend in the arrowed direction D. As the bending proceeds, the second transverse-folding line (9) of the discrete envelope unit (2) orients its direction towards the inlet (T.P2) of the second pair of rollers (53) and (54) and then inserted between these rollers (53) and (54). The main envelope processor (27) is provided with delivery means (59) that delivers discrete envelopes (E.U) each containing discrete intermediate paper(s) (4) fed by the transverse folding unit (47), heating means (62), for example, such as the one alternately having a roller (60) and a heater panel (61), pressurizing means (63) comprising a plurality of rollers, and a conveyer (64) that delivers the sealed complete envelopes to any desired processors. Reference number 65 of FIG. 6 indicates the submotor driving rollers of said heating means (62) and pressurizing means (63).

Figure 6:
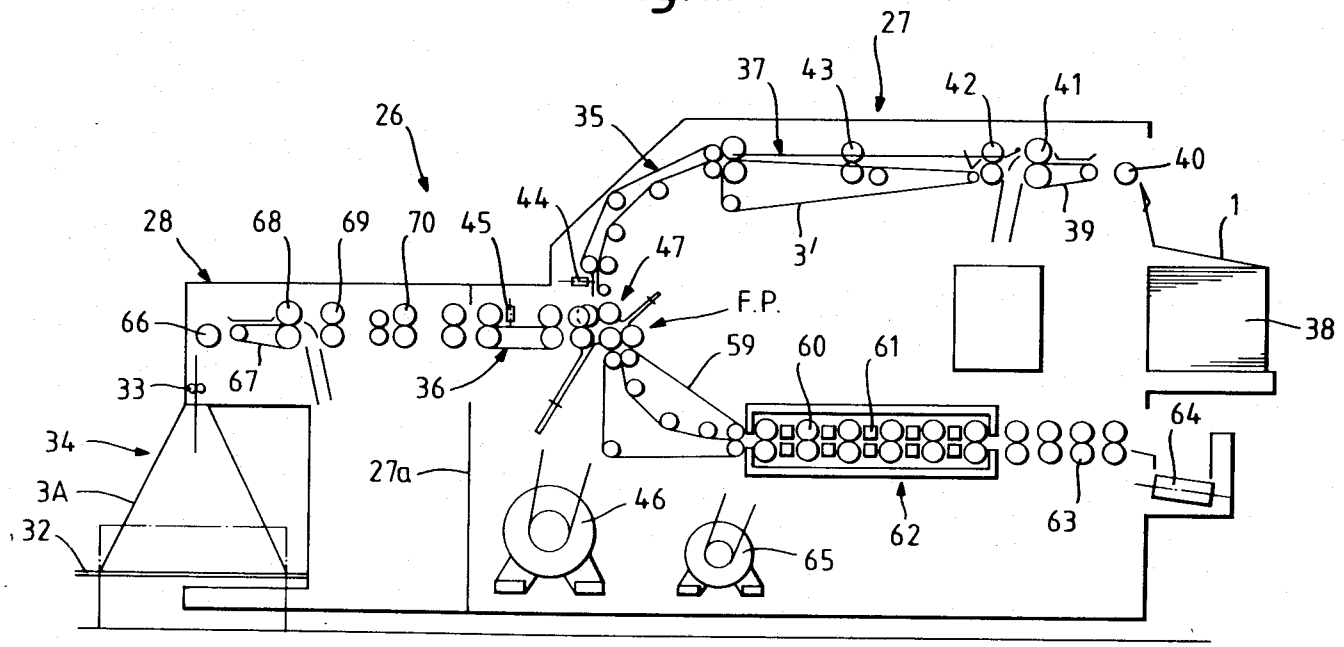
FIG. 6 is a simplified lateral view of the first embodiment in which the main envelope processor is combined with the intermediate element burst processing unit.
Figure 7:
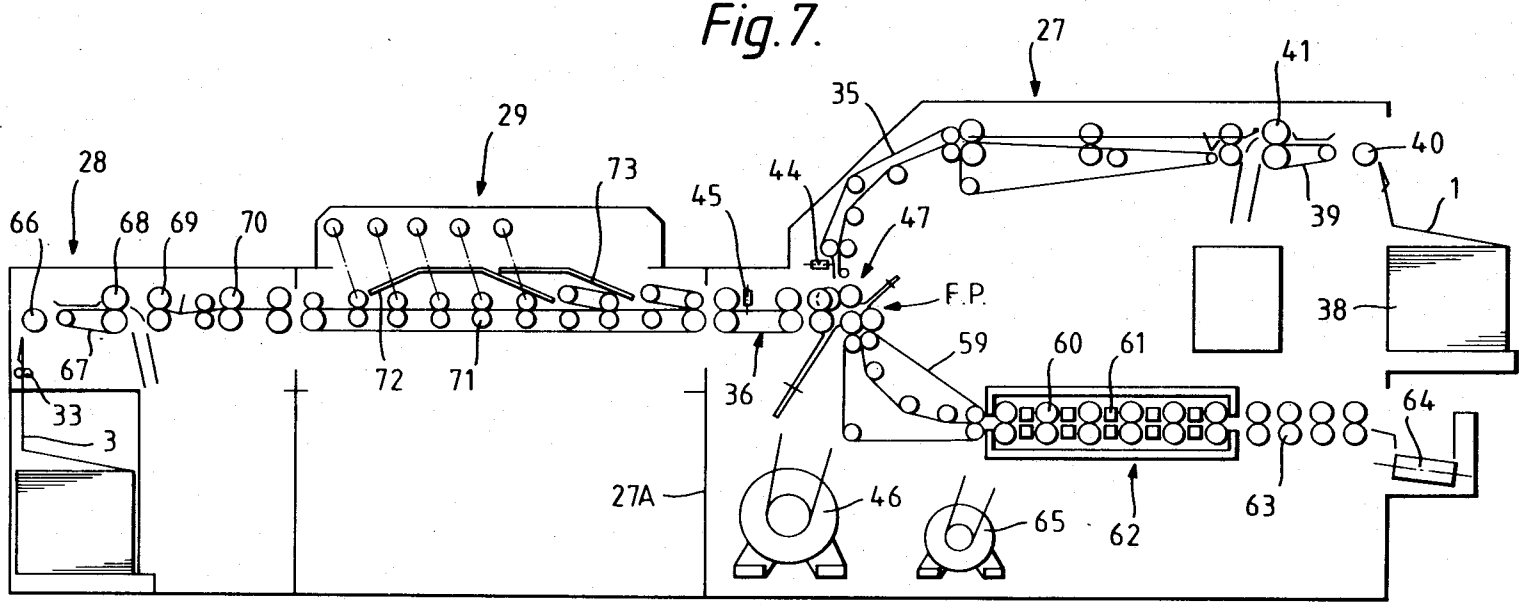
FIG. 7 is a simplified lateral view of the second embodiment in which the intermediate element burst processing unit is combined with the longitudinal three-folding unit available for processing intermediate elements.
Figure 8:
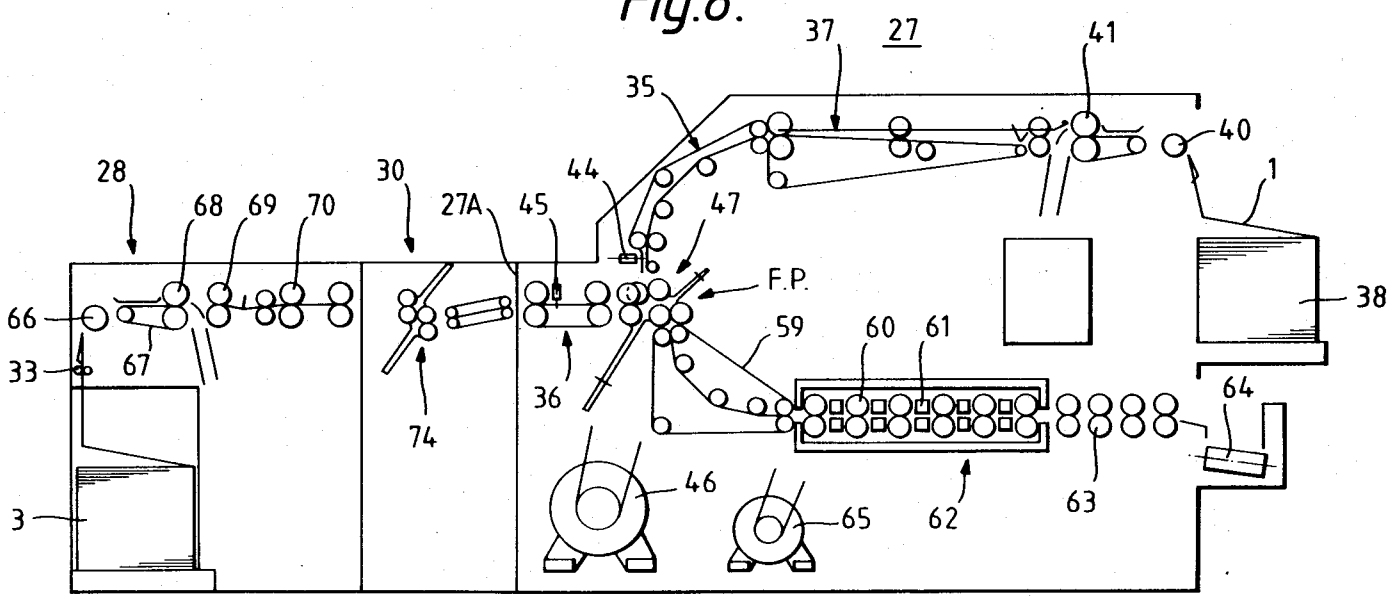
FIG. 8 is a simplified lateral view of the third embodiment in which the transverse folding unit is combined with the intermediate element burst processing unit in place of the longitudinal three-folding unit.
Figure 9:
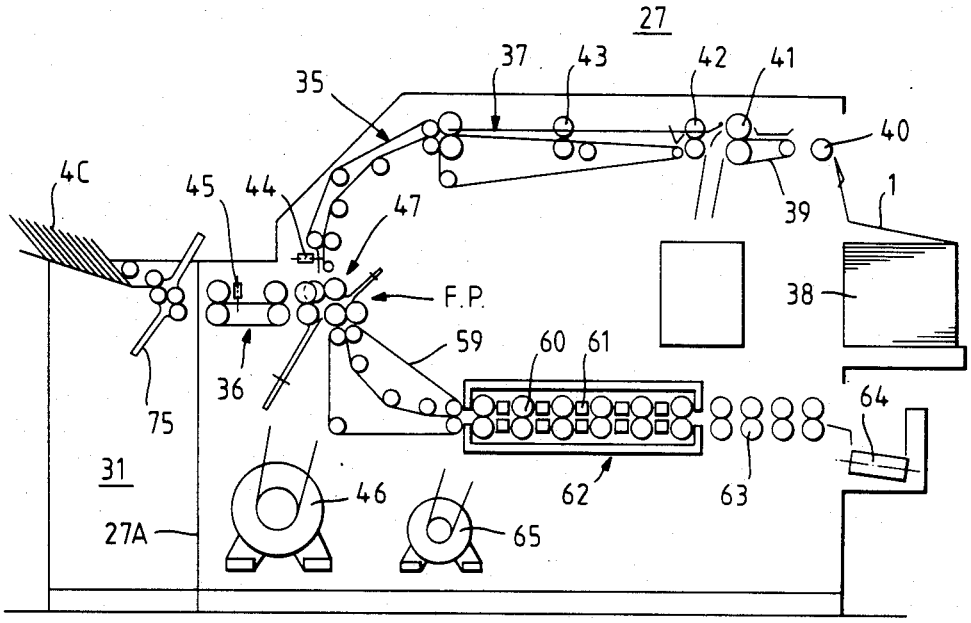
FIG. 9 is a partial lateral view of the fourth embodiment in which the simple intermediate element inserting unit is combined.
Figure 10:
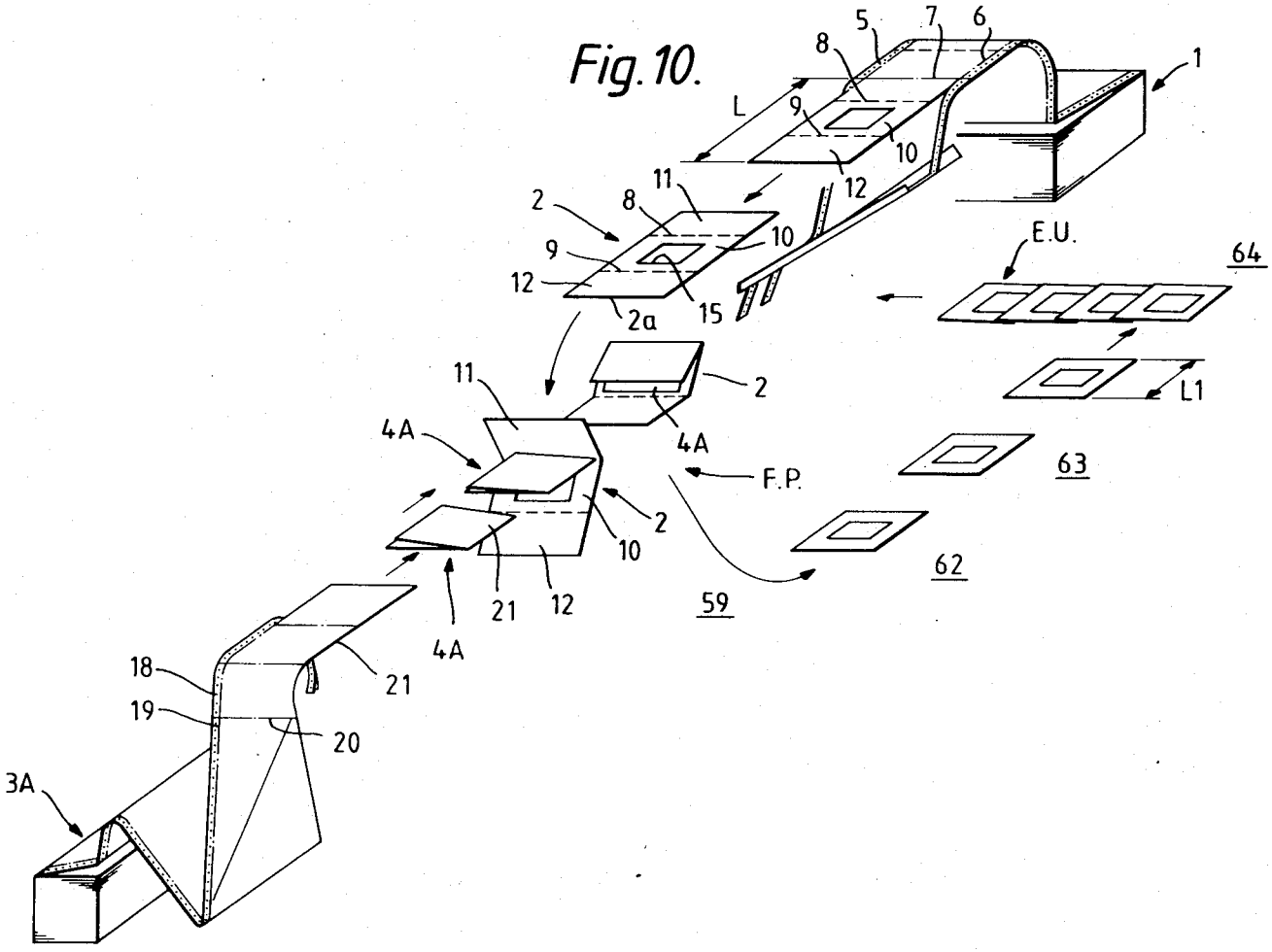
FIG. 10 is a perspective view showing the configuration of the discrete envelope according to the first embodiment shown in FIG. 6.
Figure 11:
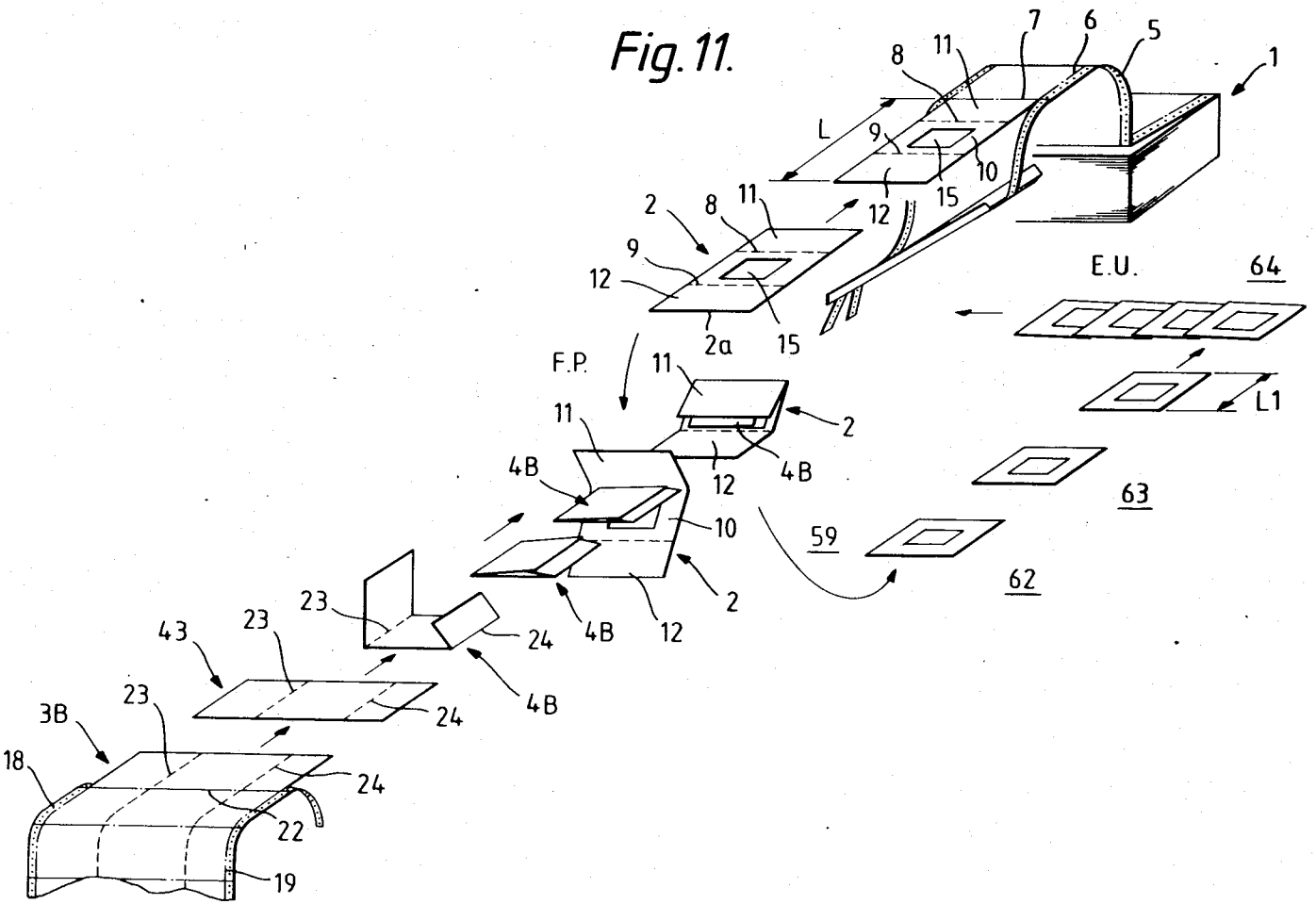
FIG. 11 is a perspective view showing the configuration of the discrete envelope according to the second embodiment shown in FIG. 7.

In reference to FIGS. 6 through 9, a variety of the intermediate element processors subject to selective combination with the main envelope processor (27) are described below. As described, above, the intermediate element processors available for the preferred embodiments of the present invention comprises the burse processing unit (28), the identical direction longitudinal triple-folding unit (29), transverse-folder unit (30), and the insertion unit (31), any of which can be selectively combined with the main envelope processor (27). One of the preferred embodiments shown in FIG. 6 is suited for processing such intermediate elements shown in FIG. 4, where the intermediate element burst processing unit (28) is directly connected to the intermediate element feed-in connection terminal (27A) of the main envelope processor (27). The burst processing unit (28) is provided with the longitudinal folder unit (34) in its front part, which comprises the continuous sheet expander bar (32) and a pair of the fold-edge aligning rollers (33). Further, the intermediate paper burst processing unit (28) is provided with the guide rollers (66), pin tractor (67), splitter that splits the marginal perforations, and a pair of rollers (69) and (70) to tear intermediate element (4) along the tearable weakening lines of the continuous sheet (3) that makes up discrete intermediate elements. According to this embodiment, the intermediate element forming continuous sheet (3) is first folded by means of the longitudinal folder (34) provided in the front part of the burst processing unit (28) before being burst-processed and formed into discrete intermediate elements (4A) shown in FIG. 4, which are then delivered to the second feeder unit (36) of the main envelope processor (27). One of the preferred embodiments shown in FIG. 7 is suited for producing such intermediate elements shown in FIG. 4-B, wherein it comprises the identical direction longitudinal triple-folding unit (29) provided between the main envelope processor (27) and the burst processing unit (28) which are connected to each other. The identical direction longitudinal triple-folding unit (29) comprises a plurality of rollers (71) that form the intermediate paper delivery path, and folding guides (72) and 73) provided on both sides along the paper path, thus making it possible to fold the burst-processed discrete intermediate papers to be folded in the identical direction. One of the preferred embodiments shown in FIG. 8 uses the traverse-folding unit (30) between the main envelope processor (27) and the intermediate element burst processing unit (28). The traverse-folding unit (30) is provided with folding rollers (74) having the siimilar configuration to that of the folding unit (47) described earlier. One of the preferred embodiments shown in FIG. 9 uses an insertion unit (31) for inserting a simple intermediate element (4C) into the intermediate paper feed-in connection terminal (27A) of the main envelope processor (27). The insertion unit (31) may be of such a configuration to feed a discrete element as an intermediate element or such a configuration provided with the traverse-folding unit (75) to feed a discrete intermediate element folded at least along a fold line.

The window provided sealed mail manufacturing apparatus based on the preferred embodiments of the present invention comprising the configurations described above can be realized by using such an envelope-forming continuous sheet reasonably provided with adhesive layers according to a pre-determined specific pattern and such an intermediate paper forming continuous sheet containing characters preliminarily printed by the computerized printers without provision of the adhesive layer at all, thus ideally suited for the computerized printing process, in particular, for the non-impact printing process. In addition, since the bonding is achieved along the center line on the part of rear surface sheet of discrete envelope unit without providing any adhesive layer along the transverse edges of the envelope-forming continuous sheet, any kind of troubles related to the intermediate elements caused by the location of the adhesive layer can be eliminated. In addition, since the lateral bonding part of envelopes can be set at such a position enough to cover the thickness of the intermediate elements, envelopes can be securely sealed independent of the thickness of the intermediate elements.

What is claimed is:

1. Apparatus for manufacturing sealed postal envelope assemblies using a discrete envelope unit split from an envelope-forming continuous sheet and an intermediate element having sizes adapted to be enclosed within said envelope unit, said apparatus comprising:

(a) a main envelope processing unit for producing envelopes from said envelope-forming continuous sheet, each of said envelopes having a front layer and a rear layer, said envelope-forming continuous sheet having transverse weakening lines at regular intervals to define an envelope unit section between each adjoining pair of said weakening lines, said envelope unit section having (i) first and second transverse folding lines defining a first area there between for forming said front layer of said envelope, (ii) a second area for forming one portion of said rear layer of said envelope, said second area being connected to said first area at said first transverse folding line, (iii) a third area for forming the other portion of said rear layer of said envelope, said third area being connected to said first area at said second transverse folding line, (iv) longitudinal adhesive layers formed on one surface of said envelope unit section along each of the opposite side edges of said envelope unit section, and (v) a transverse adhesive layer formed on the same surface of said envelope unit section as said longitudinal adhesive layers, said transverse adhesive layer being disposed along the transverse edge of said third area distal to said second transverse folding line, said main envelope processing unit including, (I) a stock of said envelope-forming continuous sheet, (II) means for continuously supplying said envelope-forming continuous sheet from said stock, (III) means located downstream of said continuous supplying means for successively separating said envelope-forming continuous sheet along said transverse weakening lines into discrete envelope unit sections, (IV) first feeder means located downstream of said successively separating means for feeding each of said discrete envelope units to an envelope folding and intermediate element inserting station, (V) a folding operation unit in said envelope folding and intermediate element inserting station, said folding operation unit having first folding means for folding said discrete envelope unit along said first transverse folding line and second folding means for folding said discrete envelope unit along said second transverse folding line, (VI) second feeder means for feeding said intermediate element to said envelope folding and intermediate element inserting station, (VII) first sensor means for detecting the delivery timing of said discrete envelope unit delivered by said first feeder means, (VIII) second sensor means for detecting the delivery timing of said intermediate element delivered by said second feeder means, (IX) means for controlling the delivery of said discrete envelope unit to said envelope folding and intermediate element inserting station based on output signals from said first and second sensor means to that said intermediate element can be inserted into said discrete envelope unit section, and (X) means for sealing said folded discrete envelope unit along said longitudinal and transverse adhesive layers of said discrete envelope unit to form a completed envelope assembly; and (b) an intermediate element supply unit connected to said main envelope procesing unit for supplying said intermediate element to said second feeder means of said main envelope processing unit, said intermediate element supply unit including, (i) a first unit having a stock of first intermediate element-forming continuous sheet having transverse weakening lines at regular intervals, means for continuously supplying said first intermediate element-forming continuous sheet from said stock, means for folding said first intermediate element-forming continuous sheet in at least one longitudinal direction during the continuous supply of said first intermediate element-forming continuous sheet, means for bursting said first intermediate element-forming continuous sheet folded along said weakening wherein said intermediate supply unit exchangeably and selectively supplies said intermediate element to said second feeder means of said main envelope processing unit.

2. An apparatus according to claim 1 wherein said intermediate element supply unit comprises:

a unit having a stock of a first intermediate element-forming continuous sheet having transverse weakening lines at regular intervals, means for continuously supply said first intermediate element-forming continuous sheet from said stock, means for folding said first intermediate element-forming continuous sheet in at least one longitudinal direction during the continuous supply of said first intermediate element-forming continuous sheet, means for bursting said first intermediate element-forming continuous sheet folded along said weakening lines to form discrete first intermediate elements folded in at least one longitudinal direction, and means for supplying said discrete first intermediate elements to said second feeder means of said main envelope processing unit.

3. An apparatus according to claim 1 wherein said intermediate element supply unit comprises a second unit comprising a stock of a second intermediate element-forming continuous sheet having transverse weakening lines at regular intervals, means for continuously supplying said second intermediate element-forming continuous sheet from said stock, means for bursting said second intermediate element-forming continuous sheet along said weakening lines to form split second intermediate element sheets, means for folding each of said split second intermediate element sheets along at leat one longitudinal line to form discrete folded second intermediate elements, and means for feeding said folded second intermediate elements to said second feeder means of said main envelope processing unit.

4. An apparatus according to claim 1 wherein said intermediate element supply unit comprises:

a third unit comprising a stock of a third intermediate element-forming continuous sheet having transverse weakening lines at regular intervals, means for continuously supplying said third intermediate element-forming continuous sheet along said weakening lines to form split third intermediate element sheets, means for folding each of said third intermediate element sheets along at least one transverse line to form discrete folded third intermediate elements, and means for feeding said third intermediate elements to said second feeder means of said main envelope processing unit.

5. An apparatus according to claim 2, 3 or 4 wherein said intermediate supply unit exchangeably and selectively supplies one of said first, second or third intermediate elements to said second feeder of said main envelope processing unit.

* * * * *

UNITED STATES PATENT AND TRADEMARK OFFICE

CERTIFICATE OF CORRECTION

PATENT NO. : 4,668,212

DATED : May 26, 1987

INVENTOR(S) : Ryuichi Kotani

It is certified that error appears in the above-identified patent and that said Letters Patent is hereby corrected as shown below:

In Col. 9, line 60 through Col. 10, line 5, please delete the following:

-- said intermediate element supply unit including, (i) a first unit having a stock of first intermediate element-forming continuous sheet having transverse weakening lines at regular intervals, means for continuously supplying said first intermediate element-forming continuous sheet from said stock, means for folding said first intermediate element-forming continuous sheet in at least one longitudinal direction during the continuous supply of said first intermediate element-forming continuous sheet, means for bursting said first intermediate element-forming continuous sheet folded along said weakening --

Signed and Sealed this

Twenty-seventh Day of June, 1989

*Attest:*

*Attesting Officer*

DONALD J. QUIGG

*Commissioner of Patents and Trademarks*